US009375373B2

(12) United States Patent
Li

(10) Patent No.: US 9,375,373 B2
(45) Date of Patent: Jun. 28, 2016

(54) LIFTABLE HOSPITAL BED

(75) Inventor: Luping Li, Cixi (CN)

(73) Assignee: NINGBO KANGMAILONG MEDICAL APPARATUS CO., LTD., Zhejiang (CN)

( * ) Notice: Subject to any disclaimer, the term of this patent is extended or adjusted under 35 U.S.C. 154(b) by 183 days.

(21) Appl. No.: 13/980,799

(22) PCT Filed: Jan. 13, 2012

(86) PCT No.: PCT/CN2012/070346

§ 371 (c)(1),
(2), (4) Date: Oct. 30, 2013

(87) PCT Pub. No.: WO2013/033980

PCT Pub. Date: Mar. 14, 2013

(65) Prior Publication Data

US 2014/0041120 A1 Feb. 13, 2014

(30) Foreign Application Priority Data

Sep. 9, 2011 (CN) ..... 2011 1 0267031

(51) Int. Cl.
*A61G 7/012* (2006.01)

(52) U.S. Cl.
CPC ..... *A61G 7/012* (2013.01)

(58) Field of Classification Search
CPC ..... A61G 1/013; A61G 1/02; A61G 1/0212; A61G 1/0237; A61G 1/056; A61G 1/0562; A61G 7/005; A61G 7/012; A61G 7/018; A61G 13/04; A61G 13/06
USPC ..... 5/11, 86.1, 611, 620, 625–627; 108/116, 117, 145, 147.22; 128/845; 280/640; 296/20; 606/242
See application file for complete search history.

(56) References Cited

U.S. PATENT DOCUMENTS 114,034 A * 4/1871 Pettit ..... B25H 1/06 182/153
5,084,922 A 2/1992 Louit
(Continued)

FOREIGN PATENT DOCUMENTS

CN 101199444 A 6/2008
CN 101632615 A 1/2010
(Continued)

OTHER PUBLICATIONS

Linak, "The Electric Linear Actuator", Sep. 18, 2015, http://www.linak-us.com/about/?id3+4540.*
(Continued)

*Primary Examiner* — Nicholas Polito
(74) *Attorney, Agent, or Firm* — Frost Brown Todd LLC

(57) ABSTRACT

A liftable hospital bed, comprising a bedplate base (1) and a bed leg rod (2), the upper end of the bed leg rod (2) being connected to a second roller device (7) which can slide in a track (8) on the bedplate base (1); a turning mechanism is also provided to change the included angle between the bed leg rod (2) and the bedplate base (1) in order to lift or lower the bedplate base (1), the turning mechanism including a connecting rod, which is hinged at the upper end thereof to the bedplate base (1), and a pushing mechanism (5) for pushing and turning the connecting rod (4); the lower end of the connecting rod (4) is fixedly bonded to a first connecting plate (6) which has a first sliding slot (61) and a second sliding slot (62) crossed with each other; a first pin shaft (91) and a second pin shaft (92) on the bed leg rod (2) are slidably provided in the first sliding slot (61) and the second sliding slot (62). During lifting, the ground-touching end of the bed leg rod (2) can be maintained unmoved, so as to prevent the movement of the patient's body.

6 Claims, 5 Drawing Sheets

(56) References Cited

U.S. PATENT DOCUMENTS

| | | | | |
|---|---|---|---|---|
| 6,230,344 | B1 | 5/2001 | Thompson et al. | |
| 6,868,567 | B2 * | 3/2005 | Edgerton | A61G 7/015 5/600 |
| 7,003,828 | B2 | 2/2006 | Roussy | |
| 7,334,277 | B2 * | 2/2008 | Johnson | A61G 1/0562 296/20 |
| 7,509,697 | B2 | 3/2009 | Dorenbeck | |
| 2009/0094747 | A1 * | 4/2009 | Bly | A61G 7/012 5/611 |
| 2009/0100598 | A1 * | 4/2009 | Bly | A47C 20/043 5/510 |
| 2010/0064441 | A1 | 3/2010 | Barthelt | |

FOREIGN PATENT DOCUMENTS

| | | | |
|---|---|---|---|
| CN | 201384633 | Y | 1/2010 |
| CN | 101658454 | A | 3/2010 |
| CN | 102038589 | A | 5/2011 |
| CN | 102389354 | | 3/2012 |
| CN | 102895081 | | 1/2013 |
| EP | 0496760 | B1 | 8/1992 |
| JP | 2558081 | B2 | 11/1996 |
| WO | WO 91/05532 | | 5/1991 |
| WO | WO 2012/139222 | | 10/2012 |
| WO | WO 2013/033980 | | 3/2013 |
| WO | WO 2014/048075 | | 4/2014 |

OTHER PUBLICATIONS

Linak, "Product Data Sheet—Actuator LA27", Sep. 18, 2015, http://www.linak-us.com/products/linear-actuators.aspx?product=LA27.*

International Search Report and Written Opinion dated May 3, 2012 for Application No. PCT/CN2012/070346.

International Preliminary Report on Patentability dated Mar. 12, 2014 for Application No. PCT/CN2012/070346.

International Search Report dated Apr. 7, 2013 for Application No. PCT/CN2013/070093.

International Written Opinion dated Apr. 7, 2013 for Application No. PCT/CN2013/070093.

US Office Action, Non-Final, dated Jan. 20, 2016 for U.S. Appl. No. 14/378,899.

* cited by examiner

LIFTABLE HOSPITAL BED

(I) TECHNICAL FIELD

The present invention relates to a hospital bed.

(II) BACKGROUND ART

A common hinge structure is used between a connecting rod and a bed leg rod of an existing hospital bed, where the longitudinal displacement of the bed leg rod during the folding and stretching thereof cannot be compensated, and the longitudinal position of a ground-touching end of the bed leg rod relative to the hospital bed will be changed. This results in the movement of the whole hospital bed. Because a hospital bed is always placed with one end pressing against a wall, bed legs away from the wall are normally forced to move backwards, with continuous vibration. This phenomenon generally makes a patient uncomfortable. Especially for a critically ill person whose body is full of various cannulas, dragging caused by the movement of the hospital bed may lead to serious consequences and affect the rehabilitation. However, for various reasons, the hospital bed must be able to be lifted and lowered according to specific requirements of a medical treatment. It is always a difficulty in the art to reduce the displacement of the bed legs in a process of lifting or lowering, thereby maintaining the stability of the gesture and position of a patient.

(III) CONTENTS OF THE INVENTION

In order to overcome the disadvantage of an existing hospital bed that bed legs move in a lifting or lowering process, the present invention aims to provide a liftable hospital bed in which the longitudinal positions of the bed legs relative to the hospital bed are maintained unmoved in a lifting or lowering process.

The liftable hospital bed according to the present invention comprises a bedplate base, wherein said bedplate base is supported by symmetrical bed leg rods located on the two sides of said bedplate base, and a bottom end of said bed leg rod is hinged to a first roller device touching the ground, characterized in that:

an upper end of said bed leg rod is connected to a second roller device, wherein said second roller device can slide in a track on said bedplate base, and said track is parallel to a longitudinal axis of said bedplate base;

a turning mechanism is further provided to change the included angle between said bed leg rod and said bedplate base in order to lift or lower the bedplate base, wherein said turning mechanism includes a connecting rod which is hinged at the upper end thereof to said bedplate base, and a pushing mechanism; a lower end of said pushing mechanism is hinged to said connecting rod, and said pushing mechanism pushes and pulls said connecting rod to turn relative to said bedplate base; and a lower end of said connecting rod is fixedly bonded to a first connecting plate, wherein said first connecting plate has a first sliding slot and a second sliding slot crossed with each other; and said bed leg rod is fixedly bonded to a first pin shaft and a second pin shaft, wherein said first pin shaft is slidably provided in said first sliding slot, and said second pin shaft is slidably provided in said second sliding slot.

Further, said first sliding slot and said second sliding slot are in a shape of "T" that slants to the left, wherein said first sliding slot is rectilinear and constitutes the vertical portion of said "T", and said second sliding slot is arcuated and constitutes the horizontal portion of said "T". When said bedplate base is at a low point, said first pin shaft is located at a top portion of said first sliding slot, and said second pin shaft is located at a top portion of said second sliding slot; and when said bedplate base is at a high point, said first pin shaft is located at a bottom portion of said first sliding slot, and said second pin shaft is located at a bottom portion of said second sliding slot.

Furthermore, said second sliding slot is provided on a supplementary plate connected to said first connecting plate, and there is a height difference between a plane in which said first sliding slot is located and a plane in which said second sliding slot is located.

Furthermore, said second pin shaft is provided with a sliding wheel which slides in the second sliding slot, and may reduce friction. The first pin shaft is provided with a sliding bush which slides in the first sliding slot and may reduce friction. A convex ring at a head portion of said sliding bush engages edges of the first sliding slot, thereby preventing the first pin shaft from dislodging from the first sliding slot. Said sliding bush is mounted to the first pin shaft via a lock nut.

Further, said pushing mechanism is a turbine and worm mechanism driven by a motor, and said pushing rod is the worm of said turbine and worm mechanism.

Further, said first pin shaft and said second pin shaft are provided on a second connecting plate which is fixedly bonded to the bed leg rod.

The present invention presents a structure that is symmetrical from left to right, and symmetrical from front to rear. A bed leg rod is provided respectively on the two sides at a front end and a rear end of the hospital bed, and each bed leg rod respectively has one connecting rod cooperating with it. The connecting rods on the two sides at the same end are connected by a transverse rod, and said pushing mechanism is hinged to the transverse rod.

When the motor rotates to drive the turbine, the turbine drives the worm to protract or retract. A front end of the worm drives the connecting rod to turn relative to the bedplate base, so that the two sliding slots of the connecting plate at the end of the connecting rod respectively drive the two pin shafts on the bed leg rod, thereby causing the bed leg rod to turn. Because the upper end of the bed leg rod can move in the bedplate base in a longitudinal direction, and because of the special hinge structure between the bed leg rod and the connecting rod, a hinge point between the bed leg rod and the connecting rod moves in the sliding slot, which compensates the longitudinal displacement of the ground-touching end of the bed leg rod during standing uprightly and lying horizontally, so that the longitudinal position of the ground-touching end of the bed leg rod is maintained unchanged relative to the hospital bed.

In addition, in the present invention, during lifting, because the angle between the connecting rod and the bedplate base increases, and the angle of the pushing mechanism and the connecting rod decreases, the arm of force of the pushing mechanism for pushing the connecting rod to turn is increased, so that during the lifting of the hospital bed, the pushing force of the pushing mechanism may gradually decrease, and the motor power may decrease. Because the motor power reduces, a lower-power motor can be mounted, and at the same time the service life of the motor is extended and production costs are reduced.

The advantages of the present invention are that: the longitudinal position of the ground-touching end of the bed leg is maintained unchanged relative to the hospital bed, which helps to keep the patient stable during lifting and lowering, and is advantageous to the treatment and rehabilitation thereof; in addition, the motor power may be reduced during the lifting and lowering of the hospital bed, which helps to extend the service life of the motor and reduce costs.

(IV) DESCRIPTION OF THE DRAWINGS

(V) PARTICULAR EMBODIMENTS

Figure 1:
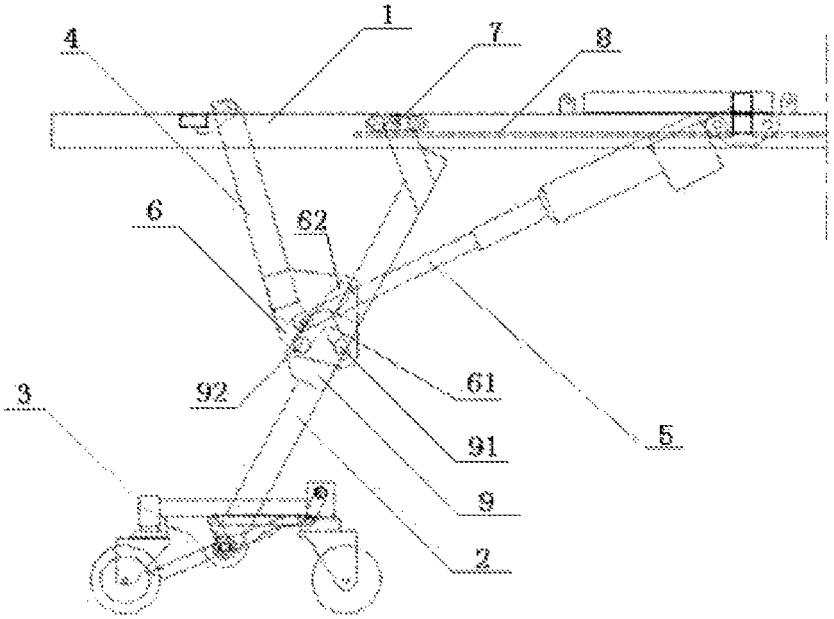
FIG. 1 is a schematic structural drawing of the present invention in a lifted state.
Figure 2:
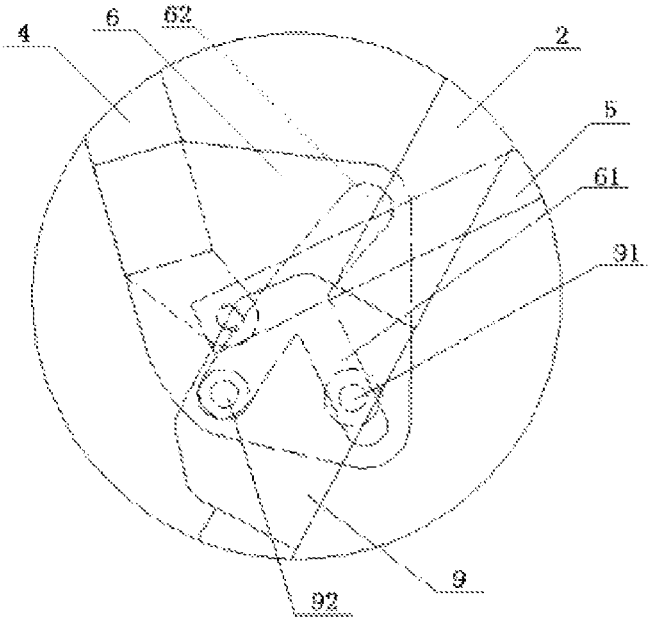
FIG. 2 is a schematic drawing of a co-operating relationship between a sliding slot of a first connecting plate at an end of a connecting rod and a pin shaft on a bed leg rod in the state as in FIG. 1.
Figure 3:
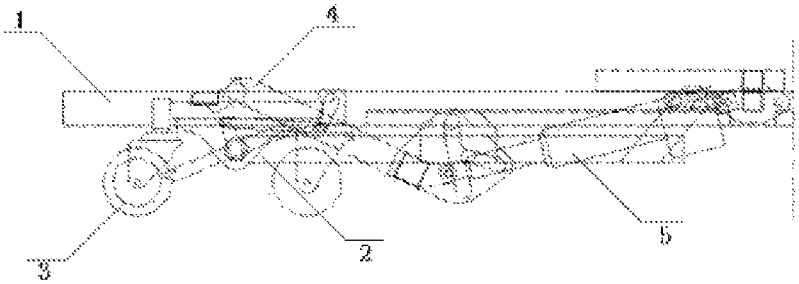
FIG. 3 is a schematic structural drawing of the present invention in a lowered state.
Figure 4:
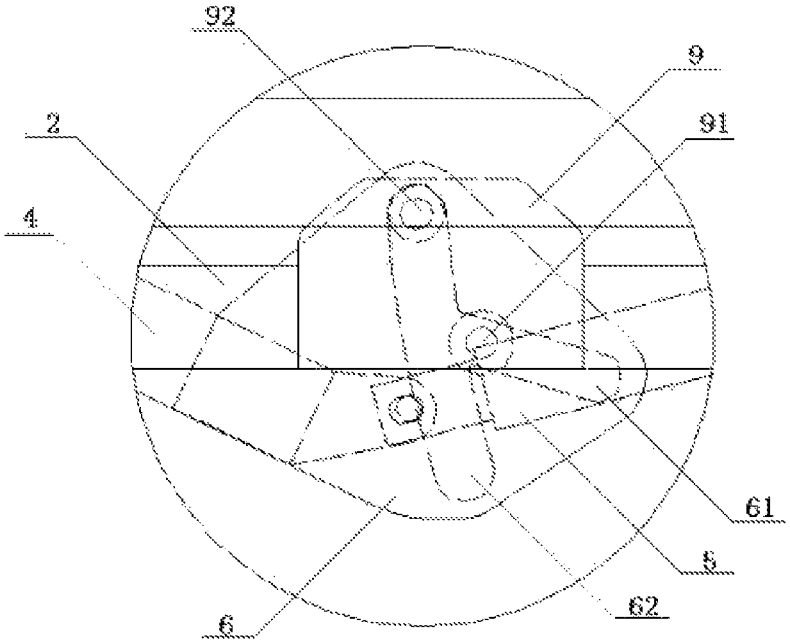
FIG. 4 is a schematic drawing of a cooperation relationship between a sliding slot of a first connecting plate at an end of a connecting rod and a pin shaft on a bed leg rod in the state as in FIG. 2.
Figure 5:
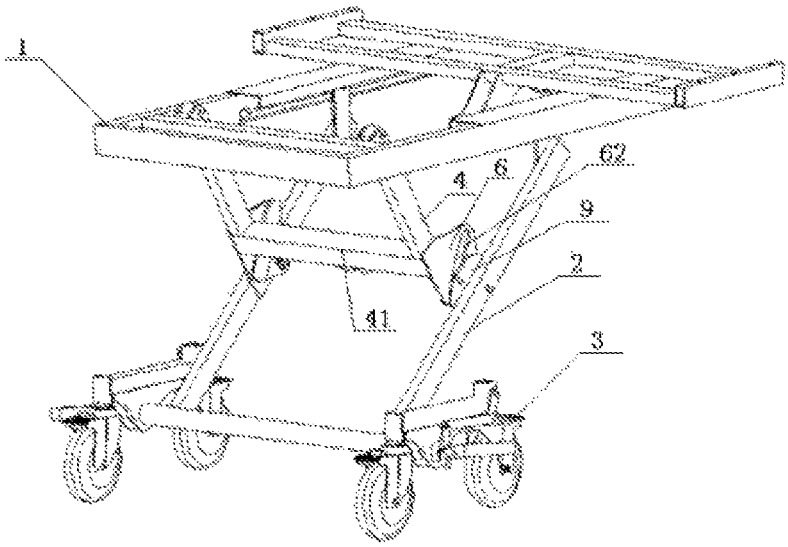
FIG. 5 is a schematic perspective view of the structure of the present invention in a lifted state, showing half of the symmetrical structure.
Figure 6:
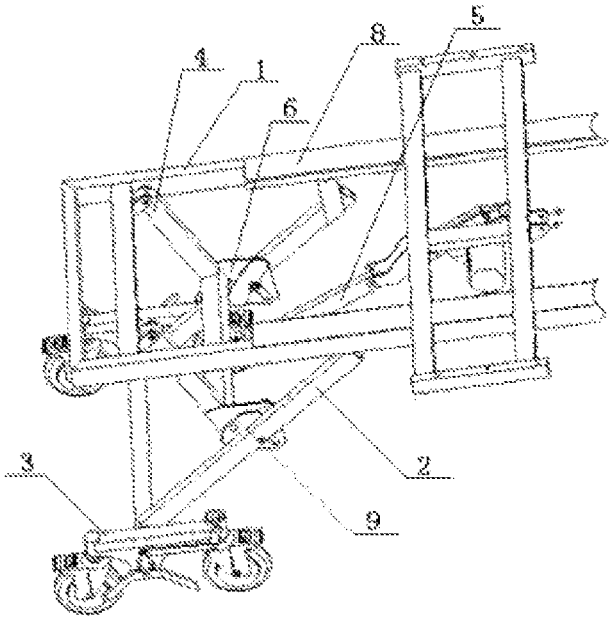
FIG. 6 is a schematic perspective view of the structure of the present invention in the lifted state from another view angle.
Figure 7:
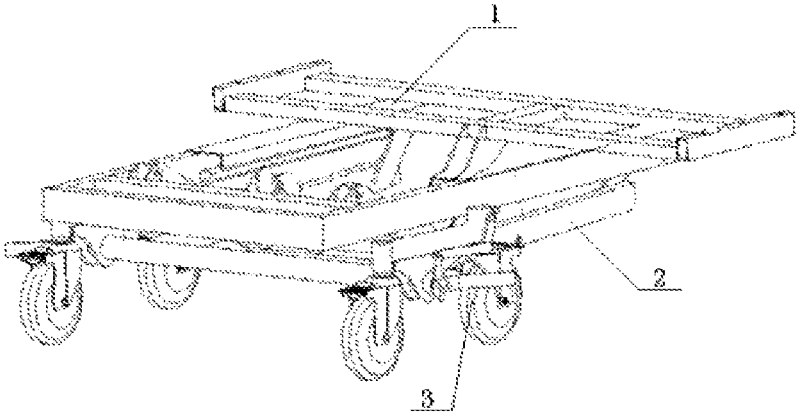
FIG. 7 is a schematic perspective view of the structure of the present invention in a lowered state, showing half of the symmetrical structure.
Figure 8:
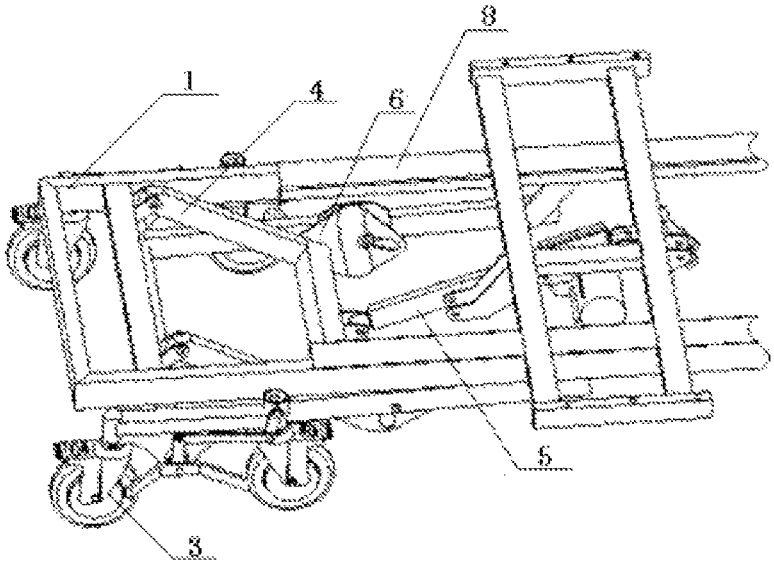
FIG. 8 is a schematic perspective view of the structure of the present invention in the lowered state from another view angle.
Figure 9:
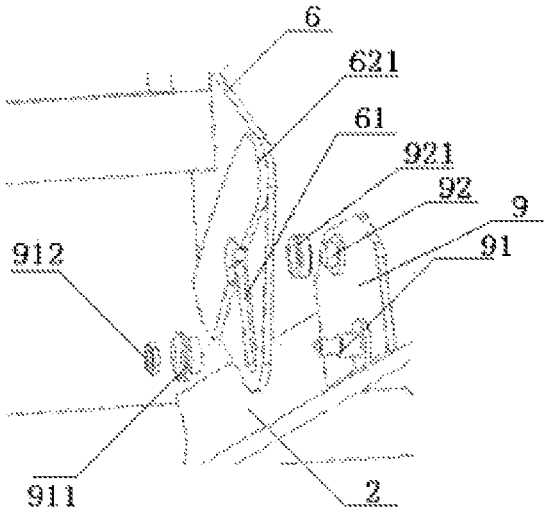
FIG. 9 is a perspective view of the co-operating relationship between the sliding slot of the first connecting plate at the end of the connecting rod and the pin shaft on the bed leg rod.

The present invention is further described below with reference to the accompanying drawings. Referring to the drawings:

A liftable hospital bed according to the present invention comprises a bedplate base 1. Said bedplate base 1 is supported by bed leg rods 2 symmetrically located on the two sides of said bedplate base, and a bottom end of said bed leg rod 2 is hinged to a first roller device 3 touching the ground.

An upper end of said bed leg rod is connected to a second roller device 7. Said second roller device 7 can slide in a track 8 on said bedplate base 1, and said track 8 is parallel to a longitudinal axis of said bedplate base 1.

A turning mechanism is further provided to change the included angle between said bed leg rod 2 and said bedplate base 1 in order to lift or lower the bedplate base 1. Said turning mechanism includes a connecting rod 4 which is hinged at the upper end thereof to said bedplate base, and a pushing mechanism 5. A lower end of said pushing mechanism 5 is hinged to said connecting rod 4, and said pushing mechanism 5 pushes and pulls said connecting rod 5 to turn relative to said bedplate base 1.

A lower end of said connecting rod 4 is fixedly bonded to a first connecting plate 6. Said first connecting plate 6 has a first sliding slot 61 and a second sliding slot 62 crossed with each other. Said bed leg rod 1 is fixedly bonded to a first pin shaft 91 and a second pin shaft 92. Said first pin shaft 91 is slidably provided in said first sliding slot 61, and said second pin shaft 92 is slidably provided in said second sliding slot 62.

Said first sliding slot 61 and the second sliding slot 62 are in a shape of "T" that slants to the left, wherein said first sliding slot 61 is rectilinear and constitutes the vertical portion of said "T", and said second sliding slot 62 is arcuated and constitutes the horizontal portion of said "T". When said bedplate base 1 is at a low point, said first pin shaft 91 is located at a top portion of said first sliding slot 61, and said second pin shaft 92 is located at a top portion of said second sliding slot 62; and when said bedplate base is at a high point, said first pin shaft 91 is located at a bottom portion of said first sliding slot 61, and said second pin shaft 92 is located at a bottom portion of said second sliding slot 62.

Said first pin shaft 91 and said second pin shaft 92 are provided on a second connecting plate 9 which is fixedly bonded to the bed leg rod 1. The second pin shaft 92 is provided with a sliding wheel 921. Said sliding wheel 921 slides in the second sliding slot 62, and can reduce friction. The first pin shaft 91 is provided with a sliding bush 911, wherein said sliding bush 911 slides in the first sliding slot 91, and can reduce friction; a convex ring at a head portion of said sliding bush 911 engages edges of the first sliding slot 61, thereby preventing the first pin shaft 91 from dislodging from the first sliding slot 61. Said sliding bush 911 is mounted to the first pin shaft 91 via a lock nut 912.

Said second sliding slot 62 is provided on a supplementary plate 621 connected to said first connecting plate 6, and there is a height difference between a plane in which said first sliding slot 61 is located and a plane in which said second sliding slot 62 is located. Because of the height difference, the first pin shaft 91 always slides in the first sliding slot 61, and the second pin shaft 92 always slides in the second sliding slot 62, thereby preventing the pin shafts from following a wrong path. Meanwhile, the supplementary plate 621 can block the sliding bush at the end of the first pin shaft 91, so the supplementary plate 521 constitutes an endplate of the first sliding slot 61.

Said pushing mechanism 5 is a turbine and worm mechanism driven by a motor, and the worm of said turbine and worm mechanism constitutes the pushing rod for pushing said connecting rod.

The present invention presents a structure that is symmetrical from left to right, and symmetrical from front to rear. Abed leg rod 2 is provided respectively on the two sides at a front end and a rear end of the hospital bed, wherein each bed leg rod 2 has a connecting rod 4 cooperating with it. The connecting rods 4 on the two sides at the same end are connected by a transverse rod 41, and said pushing rod is hinged to said transverse rod 41.

The contents described in the embodiments of the present invention are merely examples of implementations for the concept of the present invention, and the scope of protection of the present invention shall not be considered to be limited to the specific forms described in the embodiments, but instead, the scope of protection of the present invention also covers equivalent technical means that can be conceived by those skilled in the art according to the concept of the present invention.

The invention claimed is:

1. A liftable hospital bed comprising:

(a) a bedplate base, wherein said bedplate base is supported by symmetrical bed leg rods located on two sides of said bedplate base, wherein a bottom end of at least one of said bed leg rods is hinged to a first roller device touching the ground;

(b) a second roller device, wherein an upper end of said at least one of said bed leg rods is connected to said second roller device, wherein said second roller device is slidable in a track on said bedplate base, wherein said track is generally parallel to a longitudinal axis of said bedplate base;

(c) a turning mechanism, wherein the turning mechanism is operable to change an angle between said at least one of said bed leg rods and said bedplate base in order to lift or lower said bedplate base, wherein said turning mechanism includes (i) a connecting rod which is hinged at an upper end thereof to said bedplate base, and (ii) a pushing mechanism, wherein a lower end of said pushing mechanism is hinged to said connecting rod, wherein said pushing mechanism pushes and pulls said connecting rod to move relative to said bedplate base; and (d) wherein a lower end of said connecting rod is fixedly bonded to a first connecting plate, wherein said first connecting plate has a first sliding slot, wherein a supplementary plate is connected to said first connecting plate, wherein said supplementary plate has a second sliding slot, and wherein said first sliding slot and said second sliding slot are crossed with each other, and wherein there is a height difference between a plane in which said first sliding slot is located and a plane in which said second sliding slot is located, wherein said at least one of said bed leg rods is fixedly bonded to a first pin shaft and a second pin shaft, wherein said first pin shaft is slidably provided in said first sliding slot, and said second pin shaft is slidably provided in said second sliding slot.

2. The liftable hospital bed according to claim 1, wherein said first sliding slot and said second sliding slot have a "T" shape that slants to the left, wherein said first sliding slot is rectilinear and constitutes the vertical portion of said "T", and said second sliding slot is arcuated and constitutes the horizontal portion of said "T", wherein when said bedplate base is at a low point, said first pin shaft is located at a top portion of said first sliding slot, and said second pin shaft is located at a top portion of said second sliding slot, and wherein when said bedplate base is at a high point, said first pin shaft is located at a bottom portion of said first sliding slot, and said second pin shaft is located at a bottom portion of said second sliding slot.

3. The liftable hospital bed according to claim 1, wherein said second pin shaft is provided with a sliding wheel which slides in said second sliding slot, wherein said first pin shaft is provided with a sliding bush which slides in said first sliding slot, and wherein a convex ring at a head portion of said sliding bush engages edges of said first sliding slot, thereby preventing said first pin shaft from dislodging from said first sliding slot.

4. The liftable hospital bed according to claim 1, wherein said first pin shaft and said second pin shaft are provided on a second connecting plate that is fixedly bonded to said at least one of said bed leg rods.

5. The liftable hospital bed according to claim 1, wherein said pushing mechanism is a turbine and worm mechanism driven by a motor, and a pushing rod is a worm of said turbine and worm mechanism.

6. The liftable hospital bed according to claim 1, wherein said liftable hospital bed is generally of a structure that is symmetrical from left to right and symmetrical from front to rear, wherein one of said bed leg rods are provided respectively at two sides of a front end and a rear end of said bedplate base, and wherein the liftable hospital bed comprises a plurality of connecting rods, wherein each bed leg rod respectively has one of the connecting rods cooperating with it, wherein said connecting rods on the two sides at the front end or the rear end are connected by a transverse rod, and said pushing mechanism is hinged to said transverse rod.

* * * * *